US005101780A

United States Patent [19]

Jones

[11] Patent Number: 5,101,780

[45] Date of Patent: Apr. 7, 1992

[54] REDUCED STARTING LOAD SYSTEM FOR AN AUTOMOBILE ENGINE

[75] Inventor: Kenneth R. Jones, Oconomowoc, Wis.

[73] Assignee: Globe-Union Inc., Milwaukee, Wis.

[21] Appl. No.: 679,239

[22] Filed: Apr. 2, 1991

[51] Int. Cl.[5] ..... F02N 11/08

[52] U.S. Cl. ..... 123/182.1; 123/179.5; 123/179.22; 123/179.17

[58] Field of Search ..... 123/179 J, 182, 179 BG, 123/179 L

[56] References Cited

U.S. PATENT DOCUMENTS

| | | | |
|---|---|---|---|
| 1,047,114 | 12/1912 | O'Neill | 123/182 |
| 2,271,824 | 2/1942 | Johns | 123/182 |
| 2,301,440 | 11/1942 | Nardone | 123/179 J |
| 2,769,100 | 10/1956 | Peterlik et al. | 123/179 J |
| 3,496,922 | 2/1970 | Campen | 123/182 |
| 4,543,927 | 10/1985 | Luhn et al. | 123/182 |
| 4,550,704 | 11/1985 | Barbo et al. | 123/481 |
| 4,556,025 | 12/1985 | Morita | 123/198 F |
| 4,615,313 | 10/1986 | Tsumiyama | 123/182 |
| 4,875,443 | 10/1989 | Sano et al. | 123/179 G |

*Primary Examiner*—Andrew M. Dolinar
*Attorney, Agent, or Firm*—Foley & Lardner

[57] ABSTRACT

A control system for starting an internal combustion engine including a control module for controlling the operation of a multi-cylinder multiple cycle engine, a storage battery, a manually operable switch for connecting said battery to said control module, a starter motor for cranking said engine when energized, an electronically actuated set of inlet and exhaust valves, a fuel injector and a spark plug connected to each cylinder of said engine and to said control module, said control module being programmed to monitor the rotary speed of the engine for activating the valves, injector and spark plug for one cylinder when said control module determines the presence of a sufficient inertia build up in the flywheel to start the engine.

5 Claims, 1 Drawing Sheet

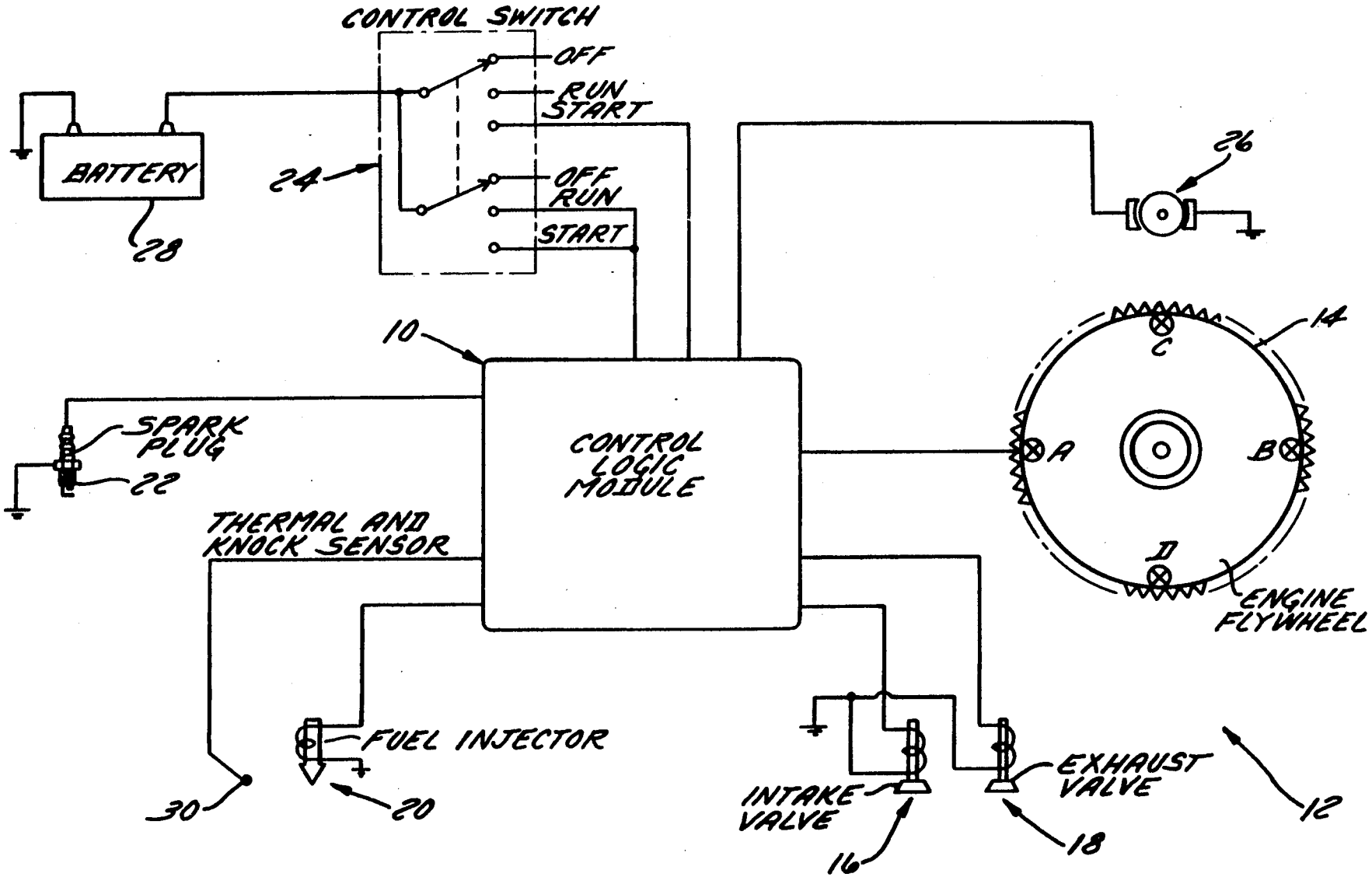
CONTROL SWITCH
OFF
RUN START
OFF RUN
START
24
BATTERY
28
26
14
ENGINE FLYWHEEL
A
B
C
D
CONTROL LOGIC MODULE
10
SPARK PLUG
22
THERMAL AND KNOCK SENSOR
30
FUEL INJECTOR
20
INTAKE VALVE
16
EXHAUST VALVE
18
12

REDUCED STARTING LOAD SYSTEM FOR AN AUTOMOBILE ENGINE

FIELD OF THE INVENTION

The present invention relates to a computer controlled start system for a multi-cylinder internal combustion engine for a vehicle and more particularly to a start system for an internal combustion engine which reduces the size of the battery required to start the engine.

BACKGROUND OF THE INVENTION

The present practice in starting an internal combustion engine requires that all cylinders be activated during the starting sequence. This requires a starting motor and battery having sufficient capacity to provide the power required to overcome the inertia of the rotating parts of the engine as well as the compressive forces in all cylinders of the engine. Typically all of the cylinders are started in sequence which does not allow the starter motor time to store energy in the flywheel to help overcome the inertia forces of the operating parts of the engine.

A number of mechanically controlled valve actuating mechanisms have been tried to reduce the starting load on the engine. These systems generally relate to mechanical devices which initially open all of the exhaust valves to reduce the compressive load in all cylinders. Typical examples of this type of system are shown in U.S. Pat. No. 4,615,313, issued Oct. 7, 1986, titled "Automatic Decompression Device For Internal Combustion Engine;" U.S. Pat. No. 4,556,025, issued Dec. 3, 1985, titled "Engine Valve Mechanism Having Valve Disabling Device;" and U.S. Pat. No. 3,496,922, issued Feb. 24, 1970, titled "Compression Relief Mechanism." However, these systems generally open the exhaust valves in all cylinders and rely on centrifugal force to gradually close the valves, which reduces the potential starting success of all cylinders because of the lowered compression. These systems cannot discriminate and reduce the compression on some of the cylinders of multi-cylinder engines nor can they sequentially select the cylinder to be used for starting the engine.

In U.S. Pat. No. 4,550,704, entitled "Multi-Cylinder Internal Combustion Engine Having Disconnectable Groups Of Cylinders," issued on Nov. 5, 1985, a logic control unit is described which provides for alternate use of groups of three cylinders or all cylinders at increased loads. U.S. Pat. No. 4,875,443, issued on Oct. 24, 1989 and entitled "Start Control System for Internal Combustion Engine", relates to the use of an electronic control unit to inject a prestart fuel into the cylinder with a time delay period before activating the starter motor.

However, none of these patents disclose nor suggest a means to automatically reduce the starting load on an engine in order to reduce the size of the battery required to start the engine.

SUMMARY OF THE PRESENT INVENTION

The present invention contemplates the use of a logic control module to selectively isolate a single cylinder during the start cycle with the exhaust valves in the other cylinders held open until the start cycle is initiated in the selected cylinder. The control module can be programmed to move on to another cylinder in the event that the first cylinder does not start within a predetermined number of cycles. Those cylinders which have been opened to reduce compression through the exhaust valve can also be signaled to stop fuel injection in the opened cylinders thus saving fuel and reducing starting emissions.

Generally an engine can be started in five seconds. If the average cranking speed of the engine is 300 rpm there will be 25 revolutions of the engine and as many as 100 compression strokes in a four cylinder engine which will blow unburned fuel out the exhaust. In accordance with the present invention most of the energy during the starting cycle will be directed to the selected cylinder. Only 12.5 compression strokes occur in the start cylinder during a five second starting period.

In one aspect of the invention, two full revolutions of the flywheel are initially provided to build up energy in the system before the start cycle is initiated in one of the cylinders.

One of the primary advantages of the present invention is the ability to use a smaller battery to start the engine. An electronically controlled solenoid valve system when combined with a control logic module as described herein reduces the starting load on the battery by more than 50%.

Other principal features and advantages of the invention will become apparent to those skilled in the art upon review of the following drawings, the detailed description and the appended claims.

BRIEF DESCRIPTION OF THE DRAWING

The drawing shows a schematic representation of a control logic module for controlling the starting cycle of one cylinder of a four cylinder internal combustion engine having a solenoid controlled valve system.

Before explaining at least one embodiment of the invention in detail it is to be understood that the invention is not limited in its application to the details of construction and the arrangement of the components set forth in the following description or illustrated in the drawing. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Referring to the drawing, a schematic representation is shown of a four cycle four cylinder engine 12 connected to a logic control module 10. The engine is represented by a flywheel 14 which is connected to drive the pistons for four cylinders A, B, C and D in a normal four cycle sequence. The control logic module 10 is connected to electronically control intake valve 16, exhaust valve 18, and fuel injector valve 20 as well as spark plug 22 for each cylinder in the engine. It should be understood that similar connections are made to each of the other cylinders. The control module 10 monitors the rotary speed of the flywheel to synchronize the timing of the operation of the valves 16, 18, fuel injectors 20 and spark plugs 22. A thermal and/or knock sensor 30 is also connected to each cylinder and to the control logic module 10 which senses the combustion temperature of the start cylinder to indicate ignition. Although a generator is not shown in the drawing, it should be understood that a generator or the like is provided for normal operation of the engine.

A storage battery 28 is shown connected through a main switch 24 to the control logic module 10 which is in turn connected to a starter motor 26. The main switch 24 is typically movable by the operator between off, run and start positions. The initial movement of the switch 24 to the run position energizes the control logic module 10. Continued rotation of the switch 24 connects the control logic module 10 to the starter motor 26 to initiate the starting rotation of the flywheel 14.

The control logic module 10 is connected to control the operating function of the cylinders in a preprogrammed sequence. The intake valve 16 and exhaust valve 18 are solenoid operated type valves which provide very precise timing of the opening and closing movements of the valves. The thermal sensors 30 provide a signal indicating a rise in temperature in the selected cylinder on ignition of fuel in the start cylinder. Once ignition is sensed, the control logic module will activate the other cylinders in the normal sequence.

It is within the contemplation of this invention to initiate the starting function of the engine in either a preselected cylinder mode or in a randomly selected cylinder mode which is determined by the position of the flywheel 14 at the time the engine is started. In the preselected cylinder mode, the control logic module 10 continues the operation of the preselected cylinder in a normal cycle sequence when the motor is started. The exhaust valves 18 in the other cylinders are opened and the fuel injector 20 is turned off so that only one cylinder is functioning. The ignition timing of the spark plug 22 is retarded in a typical way for the starting sequence, generally 10% before top dead center (BTDC). The thermal sensor 30 senses the combustion temperature in the preselected cylinder on ignition. The control logic module 10 monitors the sensors 30 to initiate the operation of the exhaust valves and fuel injection valves in all of the other cylinders. At this point, the starting motor 26 will be deactivated by the increased rpm of the flywheel in the traditional manner used on cars today or it may be regulated by the logic module. The first firing cylinder will provide enough energy in the flywheel to initiate the combustion cycle in the next cylinder. After ignition the switch 24 is moved to the run position for normal operation of the engine. In the event ignition does not occur in a predetermined number of revolutions of the flywheel, the module can be programmed to initiate the cycle of operation in the next cylinder.

If a randomly selected system is used there are two alternate modes of operation available. In both modes it is necessary to establish the rotary position of the flywheel and the cycle sequence of the cylinders. This is accomplished by providing an indicator on the flywheel and monitoring the position of the indicator to determine the cycle sequence of the cylinders. In each half cycle of revolution of the flywheel 14, one exhaust valve is normally open. The cylinder sequence can be determined by noting the position of the indicator and which exhaust valve is open, when the engine is started. Assuming the cylinder cycle sequence is A, C, B, D and the indicator on the flywheel is in the exhaust mode of the cycle of cylinder A, the next exhaust valve 18 that will be opened will be in cylinder C, which starts the operating cycle in cylinder C. On starting, all of the exhaust valves 18 will be opened until the flywheel 14 reaches the end of the first half revolution of the flywheel. The exhaust valve 18 in cylinder C will operate in the normal manner to start the cycle sequence of cylinder C. The only compressive force which the engine must overcome will then be the compression force of cylinder C.

In the alternate arrangement, assuming the same cylinder sequence as above, i.e., A, C, B, D, all of the exhaust valves are opened and remain open for the first two revolutions of the flywheel. During these first two revolutions, there will be no compressive load on the system. At the end of the two revolutions, the starting sequence is again started in cylinder C by closing the exhaust valve in the normal sequence to start the cycle sequence for ignition in cylinder C.

Thus, it should be apparent that there has been provided in accordance with the present invention a reduced starting load system for an automobile engine that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A control system for starting an internal combustion engine comprising:

a control module for controlling the operation of a multiple cylinder, multiple cycle engine, a storage battery, a manually operable switch for connecting said battery to said control module for supplying, when switched on, electric power of said battery therethrough for enabling operation of said engine, a starter motor for cranking said engine when energized, said starter motor being turned on by the electric power supplied from said battery, an electronically actuated set of inlet and exhaust valves mounted on each cylinder of said engine, and a fuel injector and a spark plug connected to said control module and being mounted on each of said cylinders, said control module being programmed to monitor the rotary speed of the engine for activating the valves, injector and spark plug for each cylinder when said control module determines the presence of a sufficient inertia build up in the flywheel to start the engine.

2. A start control system for an internal combustion engine having a multiple cylinder intake valve, an exhaust valve, a fuel injection valve and a spark plug in each cylinder, said system comprising:

a storage battery, a starter motor operably connected to the engine and to said battery and a control logic module for monitoring the speed of the engine, said module selectively activating the intake and exhaust valves, the fuel injector and spark plug for one cylinder of the engine on energizing of said starter motor, and means connected to said module for sensing combustion in said one cylinder, said module activating said valves and spark plug in the remaining cylinders when said sensing means signals ignition in said one cylinder.

3. The system of claim 2 wherein said control logic module opens the exhaust valves of the other cylinders upon selective activation of said one cylinder.

4. A method for starting a multi-cylinder internal combustion engine, comprising the steps of:

opening the exhaust valve on all of the cylinders of the engine, energizing a starter motor for the engine to initiate the rotary motion of the flywheel, and activating the spark plug, fuel injector, intake valve and exhaust valve for one cylinder to start the engine.

5. The method according to claim 4 comprising the step of sensing the temperature of said one cylinder to determine ignition and activating the valves, fuel injectors and spark plugs for the remaining cylinders when the combustion temperature is sensed.

* * * * *

UNITED STATES PATENT AND TRADEMARK OFFICE

CERTIFICATE OF CORRECTION

PATENT NO. : 5,101,780

DATED : April 7, 1992

INVENTOR(S) : Kenneth R. Jones

It is certified that error appears in the above-identified patent and that said Letters Patent is hereby corrected as shown below:

Column 4,

In Claim 2, lines 1 and 2, "A start control system for an internal combustion engine having a multiple cylinder intake valve," should read -- A start control system for a multiple cylinder internal combustion engine having an intake valve, --.

Signed and Sealed this

Twenty-second Day of June, 1993

*Attest:*

Michael K. Kirk

MICHAEL K. KIRK

*Attesting Officer*

*Acting Commissioner of Patents and Trademarks*